US006423459B1

(12) United States Patent
Sasaki et al.

(10) Patent No.: US 6,423,459 B1
(45) Date of Patent: Jul. 23, 2002

(54) ELECTROPHOTOGRAPHIC PHOTOCONDUCTOR AND MANUFACTURING METHOD FOR THE SAME

(75) Inventors: Teruo Sasaki; Kenichi Hara; Yoichi Nakamura; Shinjirou Suzuki; Hideki Kina, all of Nagano (JP)

(73) Assignee: Fuji Electric Imaging Device Co., Ltd. (JP)

( * ) Notice: Subject to any disclaimer, the term of this patent is extended or adjusted under 35 U.S.C. 154(b) by 0 days.

(21) Appl. No.: 09/717,435

(22) Filed: Nov. 21, 2000

(30) Foreign Application Priority Data

Nov. 24, 1999 (JP) ..... 11-333107

(51) Int. Cl.[7] ..... G03G 5/06

(52) U.S. Cl. ..... 430/56; 430/78; 430/59.4; 430/59.5; 430/133; 430/135

(58) Field of Search ..... 430/59.4, 59.5, 430/78, 133, 135, 56

(56) References Cited

U.S. PATENT DOCUMENTS 5,773,181 A * 6/1998 Molaire et al. ..... 430/78
5,876,889 A * 3/1999 Nakamura et al. ..... 430/96

FOREIGN PATENT DOCUMENTS

JP 06236056 A * 8/1994 ..... 430/59.4

* cited by examiner

*Primary Examiner*—Christopher Rodee
(74) *Attorney, Agent, or Firm*—Morrison Law firm

(57) ABSTRACT

A photosensitive layer of an electrophotographic photoconductor has at least one phthalocyanine compound, wherein the photosensitive layer contains a metal phthalocyanine compound bonded by an o-phthalonitrile compound as a ligand. The o-phthalonitrile ligand is present in an amount from about 100 nmol to about 200 nmol with respect to 1 mol of the phthalocyanine. The resulting electrophotographic photoconductor exhibits a high potential retention rate. A method for making such an electrophotographic photoconductor is also disclosed wherein a photosensitive layer is formed by coating, with a coating layer, to obtain a photosensitive layer having a high potential retention rate.

11 Claims, 3 Drawing Sheets

ELECTROPHOTOGRAPHIC PHOTOCONDUCTOR AND MANUFACTURING METHOD FOR THE SAME

BACKGROUND OF THE INVENTION

The present invention relates to an electrophotographic photoconductor (also referred to hereinafter as "a photoconductor") in particular, the present invention relates to a photoconductor having an improved photosensitive material in a photosensitive layer containing organic materials formed on a conductive substrate. The photoconductor of the present invention exhibits an excellent potential retention rate. Such a photoconductor is used preferably in a printer, a copier or a facsimile machine that employs an electrophotographic process. The present invention also relates to a method for manufacturing such a photoconductor.

Electrophotographic photoconductors are generally required to maintain surface charges in the dark, generate charges upon receipt of light, and transport charges upon receipt of light. The conventional types of photoconductors include a so-called single-layer type photoconductor, having these functions in a single layer, and a so-called function-separated laminated-layer type photoconductor, having a layer that mainly serves to generate charges and a layer that serves to maintain surface charges in the dark and to transport charges upon receipt of light.

These conventional photoconductors are used for forming images by known electrophotographic methods, such as the Carlson method. The image formation of this method is performed by charging the photoconductor by a corona discharge in the dark, forming an electrostatic latent image, such as characters or drawings of an original, on the charged surface of the photoconductor, developing the thus formed electrostatic image by means of toner powder, transferring and fixing the toner powder representing the image onto a support, such as paper. After the toner transfer, the residual toner powder is removed, and residual charges are erased by light exposure, so that the photoconductor can be used again.

As photosensitive material of the electrophotographic photoconductor, practitioners have used inorganic photoconductive substances, such as selenium, selenium alloys, zinc oxide and cadmium oxide, dispersed in a resin binder, as well as organic photoconductive substances, such as poly-N-vinylcarbazole, poly(vinyl anthracene), phthalocyanine compound or bisazo compound, dispersed in a resin binder or subjected to vacuum deposition, for example.

In these organic photosensitive materials, synthesis methods for a phthalocyanine compound have been extensively studied, including the derivative impurities that are side products in the synthesis process. Japanese Unexamined Patent Application Publication (KOKAI) No. H3-35245 discloses studies on the side product of titanyloxo (chlorophthalocyanine) in the synthesis process of titanyloxophthalocyanine. This publication describes that chlorine inclusion of 0.38 to 5 wt % has been confirmed by the examples until that time. The reference further discloses detailed studies on the synthesis process of titanyloxophthalocyanine which process does not generate a by-product of a chlorophthalocyanine.

Further, an example of a molecular structure of a phthalocyanine compound is known, in which an o-phthalonitrile compound is bonded as a ligand, as disclosed by I. M. Keen and B. W. Malerbi, in *J. Inorg. Nucl. Chem.*, vol. 27, p.1311–1319 (1965). The reference discloses, as examples of metal phthalocyanine compounds having a molecular structure in which an o-phthalonitrile compound is bonded as a ligand; (phthalocyanino) chlororuthenium(III) monophthalonitrilate, (phthalocyanino) chloroosmium(III) monophthalonitrilate, (phthalocyanino) dioxoosmium(VI) monophthalonitrilate, and (monochlorophthalocyanino) chloroiridium(III) monophthalonitrilate.

However, this kind of metal phthalocyanine has not been disclosed by any other reference except for the above-cited reference by I. M. Keen et al. In particular, the exemplified metal phthalocyanines in the reference are limited to the elements of the platinum group, and the other metal phthalocyanine compounds having phthalonitrile compound ligand have not been disclosed. Thus, there has never been any study on relationship between content of that kind of metal phthalocyanine and a potential retention rate in a photoconductor.

Japanese Unexamined Patent Application Publication (KOKAI) Nos. H5-273775 and H9-230615 disclose that a titanylphthalocyanine reacts with a diol to form a titanium complex. However, these references aim to obtain a photoconductor of high sensitivity, rather than to achieve high potential retention rate. Furthermore, they do not mention a metal phthalocyanine compound having an o-phthalonitrile compound ligand.

As described above, it is well known to use a phthalocyanine compound for a photosensitive material in a photoconductor. Numerous studies have been made on the synthesis, purification and side products involving the compound. However, electrophotographic photoconductor characteristics have not clarified, until now, with respect to the substances that are the products in polymerization of a phthalonitrile compound and are not likely to contain chlorine. Although studies on various synthesis methods of a phthalocyanine compound have been disclosed, the relation of the types and contents of the side products accompanied by synthesis of a phthalocyanine compound to the electrophotographic characteristics, especially, to the potential retention rate has not been clarified. A relationship between content and potential retention rate with respect to the metal phthalocyanine being bonded by a phthalonitrile compound as a ligand, in particular, has never yet been studied.

OBJECTS AND SUMMARY OF THE INVENTION

It is an object of the present invention to provide an electrophotographic photoconductor which overcomes the foregoing problems.

It is a further object of the present invention to provide an electrophotographic photoconductor that exhibits an excellent electrophotographic characteristic, specifically, an excellent potential retention rate.

It is another object of the invention to provide a method for manufacturing an electrophotographic photoconductor including a step for forming a photosensitive layer by coating a coating liquid, the step allowing to form a photosensitive layer of an excellent potential retention rate.

Briefly stated, the present invention provides a photosensitive layer of an electrophotographic photoconductor having at least one phthalocyanine compound, wherein the photosensitive layer contains a metal phthalocyanine compound bonded by an o-phthalonitrile compound as a ligand. The o-phthalonitrile ligand is present in an amount from about 100 nmol to about 200 nmol with respect to 1 mol of the phthalocyanine. The resulting electrophotographic photoconductor exhibits a high potential retention rate. A method for making such an electrophotographic photoconductor is also disclosed wherein a photosensitive layer is formed by coating, with a coating layer, to obtain a photosensitive layer having a high potential retention rate.

According to an embodiment of the present invention, there is provided a An electrophotographic photoconductor, comprising a conductive substrate, a photosensitive layer on the conductive substrate, the photosensitive layer containing at least one phthalocyanine compound as a photosensitive material on the conductive substrate, and the photosensitive layer contains a metal phthalocyanine compound bonded by an o-phthalonitrile compound as a ligand, in an amount of from about 100 nmol to about 200 mmol with respect to 1 mol of said phthalocyanine compound.

According to a feature of the present invention, there is provided a method for manufacturing an electrophotographic photoconductor, comprising providing a conductive substrate, and forming a photosensitive layer by coating the conductive substrate with a coating liquid containing at least one charge generating substance, wherein the coating liquid contains a phthalocyanine compound and a metal phthalocyanine compound bonded by an o-phthalonitrile compound as a ligand, and the metal phthalocyanine compound is contained in an amount from about 100 nmol to about 200 mmol with respect to 1 mol of the phthalocyanine compound.

The inventors of the present invention have made numerous studies to solve the foregoing problems and found that the retention rate of a photoconductor substantially increases when a metal phthalocyanine compound bonded by an o-phthalonitrile compound as a ligand (also referred to hereinafter as "a ligand-bonded metal phthalocyanine") is contained in the layer including a phthalocyanine compound of the photosensitive layer in a specified range of content: The present invention has been accomplished according to the finding.

Thus, an electrophotographic photoconductor according to the present invention comprises a conductive substrate and a photosensitive layer thereon containing a phthalocyanine compound as a photosensitive material, wherein the photosensitive layer containing the phthalocyanine compound includes a metal phthalocyanine compound bonded by an o-phthalonitrile compound as a ligand in an amount of from about 100 nmol to about 200 mmol with respect to 1 mol of the phthalocyanine compound.

Moreover, the inventors of the present invention found that, a potential retention rate of a photoconductor substantially increases when such a coating liquid containing a charge generating substance is used in a coating step in a method for manufacturing the photoconductor that includes a phthalocyanine compound and a ligand-bonded metal phthalocyanine compound, the content of the latter with respect to the former being in a specified range. The finding lead to accomplishment of the manufacturing method of the invention.

Thus, a method for manufacturing a photoconductor according to the present invention comprises a step for forming a photosensitive layer by coating a conductive substrate with a coating liquid containing a charge generating substance, wherein the coating liquid includes a phthalocyanine compound and a metal phthalocyanine compound bonded by an o-phthalonitrile compound as a ligand, the content of the metal phthalocyanine being from about 100 nmol to about 200 mmol with respect to 1 mol of the phthalocyanine compound.

The photosensitive layer in the photoconductor of the invention may be either a single-layer type or a laminated-layer type, and is not limited to any one of the two types. The coating method in the manufacturing method of the invention may be selected from dip coating, spray coating, and other various method, and is not limited to any specific method.

The above, and other objects, features and advantages of the present invention will become apparent from the following description read in conjunction with the accompanying drawings, in which like reference numerals designate the same elements.

DETAILED DESCRIPTION OF THE INVENTION

Now, the invention will be described in greater detail with reference to preferred embodiments thereof and the accompanying drawings.

There are several types of known electrophotographic photoconductors, such as a negative-charging laminated-layer type photoconductor, a positive-charging laminated-layer type photoconductor, and a positive-charging single-layer type photoconductor. While the following describes a negative-charging laminated-layer type photoconductor, as an example, in detail, material and method for forming and manufacturing a photoconductor of the invention may be appropriately selected from any known material and methods, except for material and methods relating to a metal phthalocyanine compound, the metal atom of which is bonded by an o-phthalonitrile as a ligand.

Figure 1:
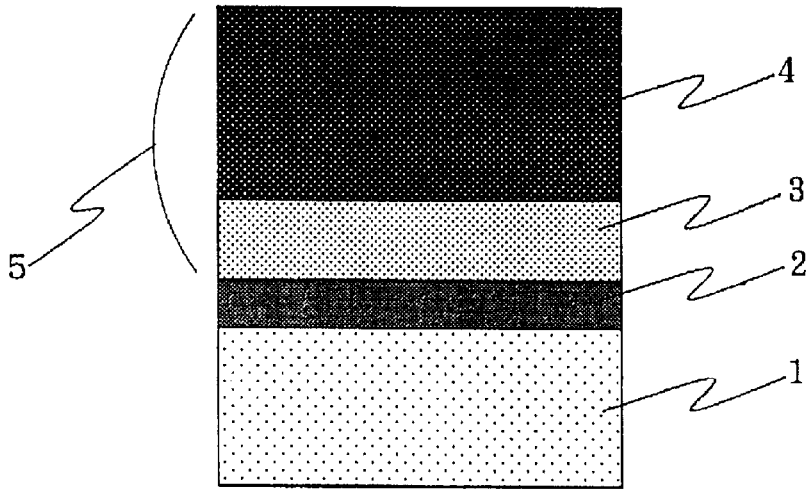
FIG. 1 is a schematic cross sectional view showing an example of a negative-charging laminated-layer type photoconductor of the present invention.

Referring to FIG. 1, a negative-charging laminated-layer type photoconductor has a conductive substrate 1, an undercoat layer 2 laminated on conductive substrate 1, and a photosensitive layer laminated on the undercoat layer. The photosensitive layer includes a charge generation layer 3 and a charge transport layer 4 laminated on charge generation layer 3. Thus, the photosensitive layer is a function separated type consisting of charge generation layer 3 and charge transport layer 4 separately formed from each other.

Undercoat layer 2 is optionally provided in any of the above-described types of a photoconductor.

Electrically conductive substrate 1 functions as an electrode of the photoconductor, while also functioning as a support for the other layers. Conductive substrate 1 may have a cylindrical shape, a planer shape, or a film shape, and may be formed of a metal or an alloy, such as aluminum, stainless steel or nickel, or glass or resin treated to be given a certain conductivity.

Undercoat layer 2 may be formed of alcohol-soluble polyamide, solvent-soluble aromatic polyamide, or thermosetting urethane resin. The alcohol-soluble polyamide may be preferably a polymer or a copolymer, such as nylon 6, nylon 8, nylon 12, nylon 66, nylon 610, or nylon 612, or N-alkyl-modified- or N-alcoxyalkyl-modified-nylon. The specific material of the above-compounds may be AMILAN CM8000 (a 6/66/610/12 copolymerized nylon available from Toray Industries, Inc.), ELBAMIDE 9061 (a 6/66/612 copolymerized nylon available from Du Pont Japan Co., Ltd.), or DAIAMIDE T-170 (a copolymerized nylon mainly composed of nylon 12, available from Daicel-Huels Co., Ltd.). Undercoat layer 2 may further include inorganic fine particles, such as $TiO_2$, $SnO_2$, alumina, calcium carbonate, or silica.

Charge generation layer 3, which generates charges upon receipt of light, is formed preferably by depositing particles of charge generating substance on undercoat layer 2 in a vacuum, or by coating undercoat layer 2 with a coating liquid in which a charge generating substance is dispersed in a solvent with a resin binder. It is important for charge generation layer 3 to have a high ability of injecting the generated charges into charge transport layer 4 as well as high efficiency of charge generation. Namely, it is desirable that charge generation layer 3 generates charges with less dependence on electric field and have excellent capability of charge generation even in a low electric field.

While the charge generating substance in the invention necessarily contains at least a phthalocyanine compound, another pigment or dye selected from azo compounds, quinone compounds, indigo compounds, cyanine compounds, squarilium compounds and azurenium compounds, for example, may also be used.

Charge generation layer 3 in the photoconductor of the invention contains a metal phthalocyanine compound bonded by an o-phthalonitrile compound as a ligand in an amount from about 100 nmol to about 200 mmol with respect to 1 mol of the phthalocyanine compound. A potential retention rate substantially increases when a photosensitive layer contains a ligand-bonded metal phthalocyanine in this specified amount with respect to a phthalocyanine compound. Though a working mechanism is not thoroughly understood, the following reasoning may be possible.

The small content of the ligand-bonded metal phthalocyanine below 100 nmol makes a phthalocyanine compound too pure and causes too fast crystal growth, or deteriorates dispersing performance, either of these resulting in decrease in the potential retention rate. On the other hand, the large content, specifically, over 200 mmol, causes too much disorder of the crystal structure of a phthalocyanine compound, or the ligand-bonded metal phthalocyanine itself raises an unfavorable action, thus, resulting in lowering of the potential retention rate.

A synthesis of a phthalocyanine compound which can be used in the invention may be conducted according to known methods, for example, the methods disclosed in "Phthalocyanines" by C. C. Leznoff et al., 1989, VCH Publishers, Inc., or "The phthalocyanines" by F. H. Moser et al., 1983, CRC Press. Both references are herein incorporated by reference.

The phthalocyanine compound in the invention may be preferably titanyloxophthalocyanine or metal-free phthalocyanine. The core metal element of the phthalocyanine may be selected from transition metals, specifically titanium, vanadium, chromium, manganese, iron, cobalt, nickel, copper, zirconium, and niobium. The core metal element of the phthalocyanine may also be selected from indium, gallium, aluminum, germanium, and tin. The phthalocyanine compound may be a phthalocyanine compound having various functional groups as represented by the general formula (1) below:

(1)

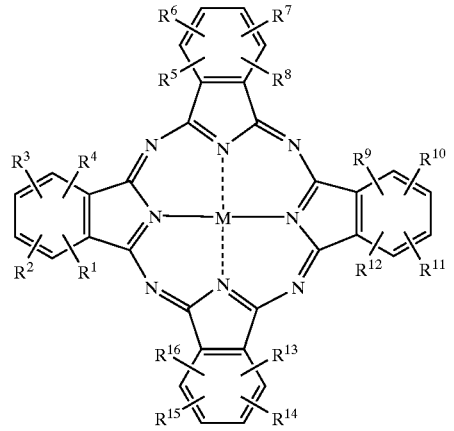

wherein M represents a metal element, a metal oxide, a metal halide, a metal hydroxide, a silicon compound, or a phosphorus compound, and each of $R^1$ to $R^{16}$ represents independently a hydrogen atom, a halogen atom, a hydroxyl group, a nitro group, a cyano group, an ester group, an alkyl group, an allyl group, an alkoxyl group, an aryl group, or a phenoxyl group.

The metal phthalocyanine compound bonded by an o-phthalonitrile compound as a ligand may be selected from various compounds including (phthalocyanino) chlororuthenium(III)-monophthalonitrilate, (phthalocyanino) chloroosmium(III)-monophthalonitrilate, (phthalocyanino) dioxoosmium(VI)-monophthalonitrilate, and (monochlorophthalocyanino) chloroiridium(II)-monophthalonitrilate, as disclosed in *J. Inorg. Nucl. Chem.*, vol. 27, p. 1311–1319 (1965). Preferably, the metal phthalocyanine compound is a titanyloxophthalocyanine compound. The o-phthalonitrile compound bonded as a ligand may have a substituent as represented by the general formula (2) below:

(2)

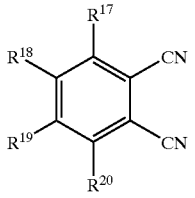

wherein each of $R^{17}$ to $R^{20}$ represents independently a hydrogen atom, a halogen atom, a hydroxyl group, a nitro group, a cyano group, an ester group, an alkyl group, an allyl group, an alkoxyl group, an aryl group, or a phenoxyl group.

The inventors found the composition system of the metal phthalocyanine compound bonded by an o-phthalonitrile compound as a ligand as described below.

Initially, a side product was found in a synthesis process of titanyloxophthalocyanine. The side product has a molecular structure in which a structure corresponding to an o-phthalonitrile compound was additionally bonded as a metal ligand of a titanyloxophthalocyanine compound. The side product has a chemical formula $(C_8H_4N_2)_5OTi$ and molecular weight 704.5, and is referred to hereinafter as "titanyloxo pentamer". The inventors succeeded in generating the side product in large quantities and isolating the side product.

Figure 2:
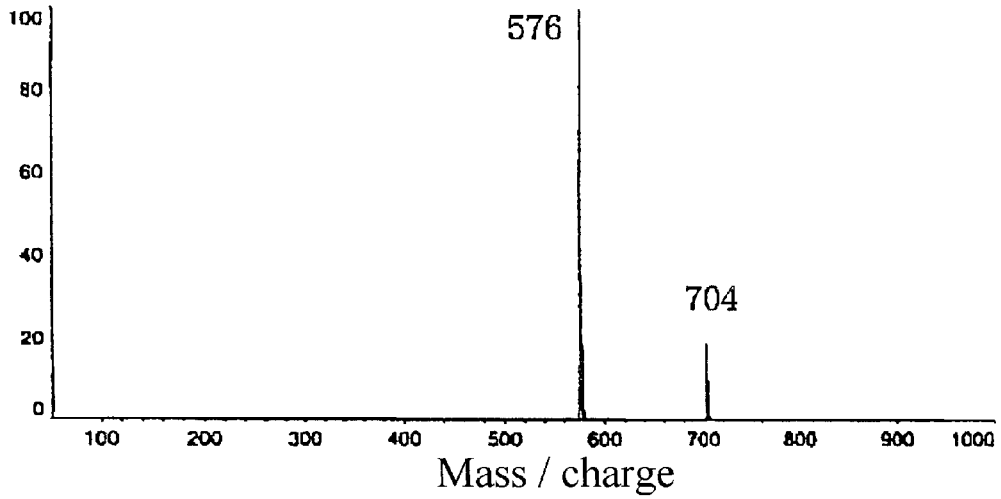
FIG. 2 is a mass spectrum chart showing a result of an anion detection analysis, as an example of TOF-MS spectrum of a titanyloxophthalocyanine containing a ligand-bonded metal phthalocyanine compound in the present invention.
Figure 3:
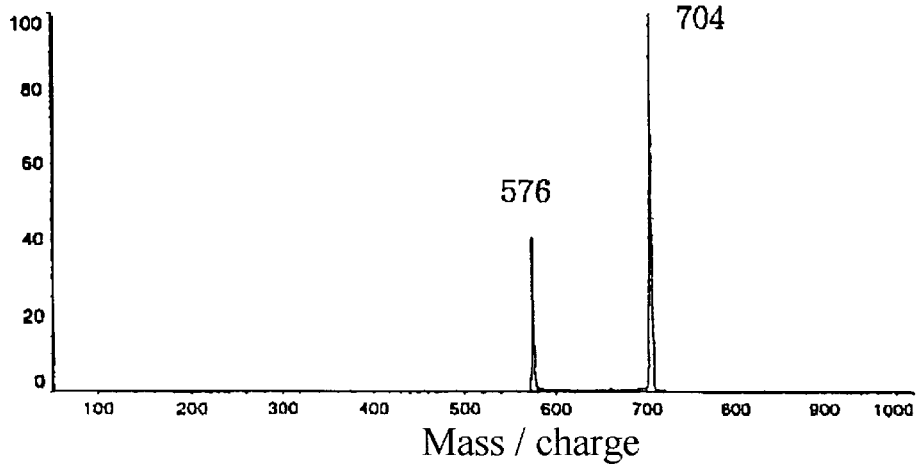
FIG. 3 is a mass spectrum chart showing a result of an MS/MS analysis on an ion of a ligand-bonded metal phthalocyanine compound molecule having the mass number of 704, as an example of TOF-MS spectrum of a titanyloxophthalocyanine containing a ligand-bonded metal phthalocyanine compound in the present invention.
Figure 4:
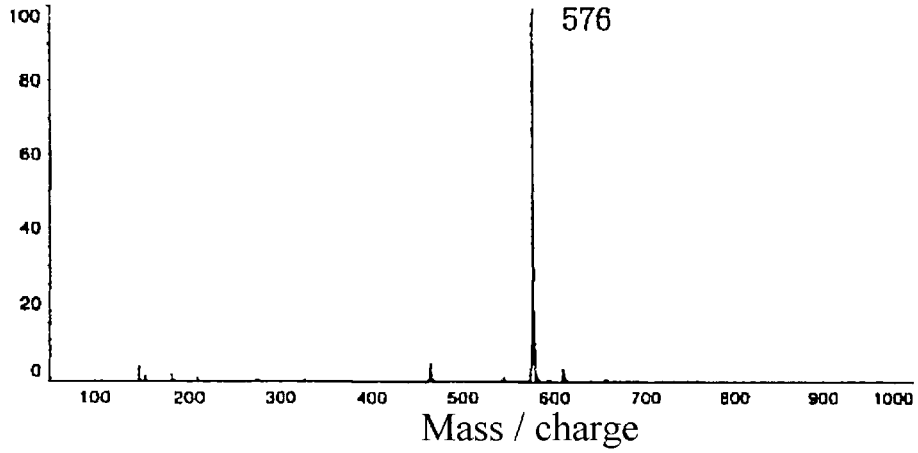
FIG. 4 is a mass spectrum chart showing a result of an cation detection analysis, as an example of TOF-MS spectrum of a titanyloxophthalocyanine containing a ligand-bonded metal phthalocyanine compound in the present invention.

In order to identify the structure of the titanyloxo pentamer, the inventors conducted an analysis by means of laser-eliminated-ionization time-of-flight mass spectroscopy (abbreviated to TOF-MS) on a titanyloxophthalocyanine sample containing the titanyloxo pentamer as a side product. FIGS. 2 through 4 are examples of TOF-MS spectrum chart of titanyloxophthalocyanine containing the titanyloxo pentamer. FIG. 2 is a result of an anion-detection analysis showing that an ion of the titanyloxo pentamer molecule with mass number 704 is detected with high sensitivity in addition to an ion of the titanyloxophthalocyanine molecule with mass number 576.

Subsequently, focussing on the ion of the titanyloxo pentamer molecule with mass number 704, an anion-detection MS-MS analysis was conducted on the ion. The result is shown in FIG. 3. The result revealed that a fragment ion with mass number 576 is generated from a parent ion with mass number 704 and that the ion of the titanyloxo pentamer molecule has a structure in which an o-phthalonitrile with molecular weight of 128 is added on outside of a phthalocyanine ring.

FIG. 4 shows the result of a cation-detection analysis on the same sample. The ion of the molecule with mass number 576 of the titanyloxophthalocyanine was detected with high sensitivity. With regard to the titanyloxo pentamer, not only the ion of that molecule, but also any other ion that reflects the structure of the titanyloxo pentamer was not detected.

Based on the above-described analyses, it has been shown concerning the structure of the titanyloxo pentamer that an additional ion which directly reflects the structure of the titanyloxo pentamer molecule is hardly generated, and that an additional phthalonitrile is bonded as a ligand in the titanyloxophthalocyanine.

In cases where the phthalocyanine compound in the invention is titanyloxophthalocyanine, the peak intensity in mass spectroscopy of the titanyloxophthalocyanine compound bonded by an o-phthalonitrile compound as a ligand with mass number 704 is preferably in the range between $10^{-5}$% and 20% with respect to the peak intensity of the titanyloxophthalocyanine with mass number 576.

A quantity of the metal phthalocyanine compound bonded by an o-phthalonitrile compound as a ligand involved in the invention can be controlled by sublimation. The metal phthalocyanine that is a side product of the synthesis process may be used as the metal phthalocyanine to be contained in a photoconductor of the invention.

The film thickness of charge generation layer 3 is preferably controlled to be not greater than 5 $\mu$m, more preferably, not greater than 1 $\mu$m.

Charge generation layer 3 contains charge generating substance as a major component, to which charge transport substance and other material may be added. The resin binder used in charge generation layer 3 may be selected from polymers and copolymers of polycarbonate, polyester, polyamide, polyurethane, epoxy, poly(vinyl butyral), phenoxy, silicone, methacrylate, and halogenated compounds and cyanoethyl compounds of these substances, which may be used in suitable combination. The charge generating substance used in charge generation layer 3 is contained preferably in an amount from about 10 to about 5000 parts by weight, more preferably from about 50 to about 1000 parts by weight with respect to 100 parts by weight of the resin binder.

Charge transport layer 4 is a coating film formed of materiel dispersing charge transport substance in a resin binder. The charge transport substance may be selected from hydrazone compounds, styryl compounds, amine compounds, and their derivatives, used alone or in suitable combination, for example. Charge transport layer 4 serves as an insulating layer in the dark for retaining charges of the photoconductor, while functioning to transport charges injected from the charge generation layer upon receipt of light. The binder resin used in charge transport layer 4 may be selected from polymers, mixed polymers, and copolymers of polycarbonate, polyester, polystyrene, and methacrylate, for example. It is important that the resin binder is selected considering compatibility with the charge transport substance, as well as the mechanical, chemical and electrical stability and adhesiveness. The charge transport substance is contained preferably in an amount from about 20 to about 500 parts by weight, more preferably, from about 30 to about 300 parts by weight with respect to 100 parts by weight of the resin binder.

The film thickness of charge transport layer 4 is preferably controlled in a range of 3 to 50 $\mu$m, more preferably 15 to 40 $\mu$m, so as to maintain a practically effective surface potential.

EXAMPLES

While the present invention is described with reference to specific examples of the embodiments of the invention in the followings, the invention is not limited to the examples.

Example 1

Fabrication of an Undercoat Layer

A coating liquid for an undercoat layer was produced by mixing 70 parts by weight of the polyamide resin AMILAN CM8000, available from Toray Industries, Inc., and 930 parts by weight of methanol. An aluminum substrate was coated with the coating liquid by a dip-coating method, and dried to form an undercoat layer having a thickness of 0.5 $\mu$m.

Synthesis of Titanyloxophthalocyanine

Initially, 800 g of o-phthalodinitrile (manufactured by Tokyo Chemical Industry Co., Ltd.) and 1.8 liter of quinoline (manufactured by Tokyo Chemical Industry Co., Ltd.) were stirred in a reaction vessel. Subsequently, 297 g of titanium tetrachloride (manufactured by Kishida Chemical Co., Ltd.) was dropwise added and stirred in a nitrogen atmosphere. The resulting mixture was heated to 180° C. in 2 hrs and stirred for 15 hrs holding at this temperature.

The resulting liquid was allowed to cool down to 130° C., and washed with 3 liter of N-methyl-2-pyrrolidinone. The resulted wet cake was heated and stirred in 1.8 liter of N-methyl-2-pyrrolidinone at 160° C. for 1 hr in a nitrogen atmosphere. The resulting mixture was allowed to cool, filtered, and washed with 3 liter of N-methyl-2-pyrrolidinone, 2 liter of acetone, 2 liter of methanol, and 4 liter of warm water in this order, to obtain a wet cake.

The thus obtained wet cake of titanyloxophthalocyanine was heated and stirred at 80° C. for 1 hr in diluted hydrochloric acid consisting of 360 ml of 36% hydrochloric acid and 4 liter of water, allowed to cool, filtered, and washed with 4 liter of warm water, and dried. The obtained article was purified by three times of vacuum sublimation, and dried.

Subsequently, 200 g of the thus obtained dry material was added to 4 kg of 96% sulfuric acid at −5° C. while being cooled and stirred so that the liquid temperature was kept at −5° C. or lower. The liquid was further stirred and cooled for 1 hr being held at −5° C. The resulting sulfuric acid solution was added to a mixture of 35 liter of water and 5 kg of ice, and stirred and cooled for 1 hr being held at 10° C. or lower. The liquid was filtered and washed with 10 liter of warm water.

The thus obtained material was mixed with diluted hydrochloric acid consisting of 10 liter of water and 770 ml of 36% hydrochloric acid, heated to 80° C. and stirred for 1 hr. The resulting liquid was allowed to cool, filtered, washed with 10 liter of warm water, and dried to obtain titanyloxophthalocyanine, which was purified by sublimation to obtain pure titanyloxophthalocyanine.

Synthesis of a Ligand-bonded Metal Phthalocyanine Compound

A synthesis process is conducted in the same manner as in the above-described synthesis process of titanyloxophthalocyanine except that the steps that were conducted in a nitrogen atmosphere were conducted in air atmosphere while steadily blowing external air into the synthesizing place.

Figure 5:
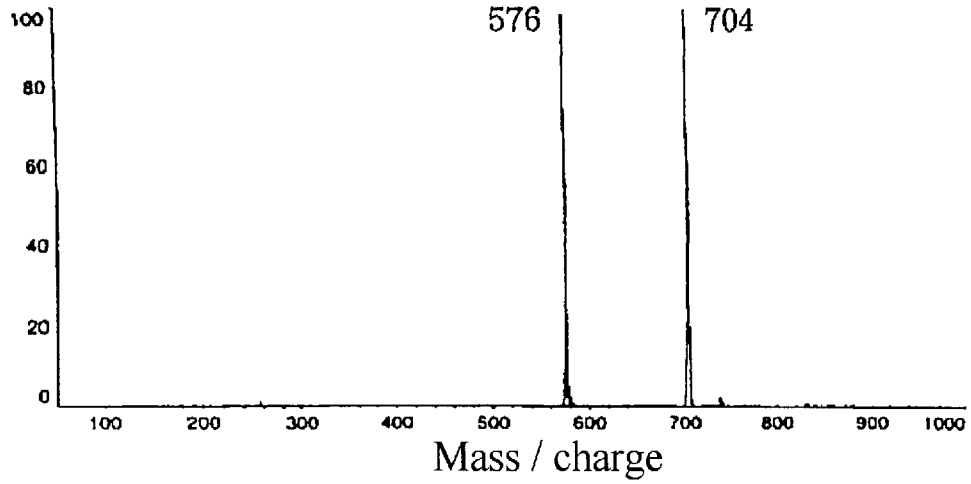
FIG. 5 is a mass spectrum chart showing a result of an anion detection analysis, as an example of TOF-MS spectrum of a titanyloxophthalocyanine containing a ligand-bonded metal phthalocyanine according to an embodiment of the present invention

This process produced a ligand-bonded metal phthalocyanine having a structure in which an additional phthalonitrile is bonded to the metal atom of the titanyloxophthalocyanine, as a mixture with the titanyloxophthalocyanine. FIG. 5 is a spectrum chart showing a result of anion-detection analysis of TOF-MS spectrum on a titanyloxophthalocyanine containing a ligand-bonded metal phthalocyanine compound.

An investigation determined the peak intensity ratio between the titanyloxophthalocyanine and the ligand-bonded metal phthalocyanine to be 1:1 in an anion-detection analysis of TOF-MS analysis. The mixture was purified by a sublimation method to obtain a purified ligand-bonded metal phthalocyanine compound. The yield of the ligand-bonded metal phthalocyanine was from 10 to 15% based on the phthalonitrile.

Fabrication of a Charge Generation Layer

One hundred nmol of the thus fabricated ligand-bonded metal phthalocyanine compound was added to 1 mol of titanyloxophthalocyanine. The mixture, together with 0.5 liter of water and 1.5 liter of o-dichlorobenzene, (manufactured by Kanto Chemical Co., Ltd.) were put into a ball mill, including 6.6 kg of zirconia balls having diameter of 8 mm, and subjected to milling for 24 hrs. The resulted mixture was extracted with 1.5 liter of acetone and 1.5 liter of methanol, filtered, washed with 1.5 liter of water, and dried.

Ten parts by weight of the titanyloxophthalocyanine containing a ligand-bonded metal phthalocyanine compound was mixed with 10 parts by weight of the vinyl chloride resin MR-110, manufactured by Nippon Zeon Co., Ltd., 686 parts by weight of dichloromethan, and 294 parts by weight of 1,2-dichloroethane, and ultrasonically dispersed, to produce a coating liquid for a charge generation layer. This coating liquid was coated on the undercoat layer by dip coating method, to form a charge generation layer having the thickness of 0.2 μm after drying.

Fabrication of a Charge Transport Layer

A coating liquid for a charge transport layer was produced by mixing 100 parts by weight of 4-(diphenylamino) benzaldehide phenyl (2-thienylmethyl) hydrazone (manufactured by Fuji Electric Co., Ltd.), 100 parts by weight of a polycarbonate resin (PANLITE K- 1300 available from Teijin Chemical Co., Ltd.), 800 parts by weight of dichloromethane, 1 part by weight of a silane coupling agent (KP-340 available from Shin'etsu Chemical Co., Ltd.), and 4 parts by weight of bis (2,4-di-tert-butyl phenyl) phenylphosphonite (manufactured by Fuji Electric Co., Ltd.). The substrate coated with the charge generation layer was coated with the coating liquid by a dip-coating method and dried to form a charge transport layer having a thickness of 20 μm. Thus, a photoconductor was fabricated.

Example 2

A photoconductor was fabricated in the same manner as in Example 1 except that the quantity of the ligand-bonded metal phthalocyanine compound added to 1 mol of the titanyloxophthalocyanine was changed to 10 μmol.

Example 3

A photoconductor was fabricated in the same manner as in Example 1 except that the quantity of the ligand-bonded metal phthalocyanine compound added to 1 mol of the titanyloxophthalocyanine was changed to 1 mmol.

Example 4

A photoconductor was fabricated in the same manner as in Example 1 except that the quantity of the ligand-bonded metal phthalocyanine compound added to 1 mol of the titanyloxophthalocyanine was changed to 100 mmol.

Example 5

A photoconductor was fabricated in the same manner as in Example 1 except that the quantity of the ligand-bonded metal phthalocyanine compound added to 1 mol of the titanyloxophthalocyanine was changed to 200 mmol.

Example 6

A photoconductor was fabricated in the same manner as in Example 1 except that after adding 100 nmol of the ligand-bonded metal phthalocyanine. compound to 1 mol of the titanyloxophthalocyanine, the resulting mixture was subjected to an acid pasting treatment with 96% sulfuric acid, then washed with water and dried to obtain a titanyloxophthalocyanine containing a ligand-bonded metal phthalocyanine compound.

Example 7

A photoconductor was fabricated in the same manner as in Example 6 except that the quantity of the ligand-bonded metal phthalocyanine compound added to 1 mol of the titanyloxophthalocyanine was changed to 10 μmol.

Example 8

A photoconductor was fabricated in the same manner as in Example 6 except that the quantity of the ligand-bonded metal phthalocyanine compound added to 1 mol of the titanyloxophthalocyanine was changed to 1 mmol.

Example 9

A photoconductor was fabricated in the same manner as in Example 6 except that the quantity of the ligand-bonded metal phthalocyanine compound added to 1 mol of the titanyloxophthalocyanine was changed to 100 mmol.

Example 10

A photoconductor was fabricated in the same manner as in Example 6 except that the quantity of the ligand-bonded metal phthalocyanine compound added to 1 mol of the titanyloxophthalocyanine was changed to 200 mmol.

Comparative Example 1

A photoconductor was fabricated in the same manner as in Example 1 except that the quantity of the ligand-bonded metal phthalocyanine compound added to 1 mol of the titanyloxophthalocyanine was changed to 50 nmol.

Comparative Example 2

A photoconductor was fabricated in the same manner as in Example 1 except that the quantity of the ligand-bonded metal phthalocyanine compound added to 1 mol of the titanyloxophthalocyanine was changed to 300 mmol.

Comparative Example 3

A photoconductor was fabricated in the same manner as in Example 6 except that the quantity of the ligand-bonded metal phthalocyanine compound added to 1 mol of the titanyloxophthalocyanine was changed to 50 nmol.

Comparative Example 4

A photoconductor was fabricated in the same manner as in Example 6 except that the quantity of the ligand-bonded metal phthalocyanine compound added to 1 mol of the titanyloxophthalocyanine was changed to 300 mmol.

An electric characteristic of each of the photoconductors from Examples 1 to 10 and Comparative Examples 1 to 4 was measured with an electrostatic recording paper test apparatus, EPA-8200 manufactured by Kawaguchi Electric Works Co. Ltd. The photoconductor was charged in the dark to the surface potential of −600 V using a corotron and held stationary in the dark for 5 seconds. A charge retention rate in this period was measured. The results are shown in Table 1.

TABLE 1

| specimen | retention rate % | Specimen | retention rate % |
|---|---|---|---|
| Example 1 | 98.1 | Comp. Example 1 | 91.5 |
| Example 2 | 97.9 | Comp. Example 2 | 90.4 |
| Example 3 | 98.2 | Comp. Example 3 | 91.3 |
| Example 4 | 97.6 | Comp. Example 4 | 90.2 |
| Example 5 | 97.6 | | |
| Example 6 | 98.3 | | |
| Example 7 | 98.0 | | |
| Example 8 | 98.2 | | |
| Example 9 | 98.1 | | |
| Example 10 | 97.7 | | |

It is apparent from Table 1 that the potential retention rates of all Examples are high and favorable, while the potential retention rates of all Comparative Examples are lower in comparison with those of Examples.

Example 11

A photoconductor was fabricated in the same manner as in Example 1 except that the titanyloxophthalocyanine was replaced by metal-free phthalocyanine synthesized according to a common method.

Example 12

A photoconductor was fabricated in the same manner as in Example 11 except that the quantity of the ligand-bonded metal phthalocyanine compound added to 1 mol of the metal-free phthalocyanine was changed to 10 $\mu$mol.

Example 13

A photoconductor was fabricated in the same manner as in Example 11 except that the quantity of the ligand-bonded metal phthalocyanine compound added to 1 mol of the metal-free phthalocyanine was changed to 1 mmol.

Example 14

A photoconductor was fabricated in the same manner as in Example 11 except that the quantity of the ligand-bonded metal phthalocyanine compound added to 1 mol of the metal-free phthalocyanine was changed to 100 mmol.

Example 15

A photoconductor was fabricated in the same manner as in Example 11 except that the quantity of the ligand-bonded metal phthalocyanine compound added to 1 mol of the metal-free phthalocyanine was changed to 200 mmol.

Example 16

A photoconductor was fabricated in the same manner as in Example 11 except that after adding 100 nmol of the ligand-bonded metal phthalocyanine compound to 1 mol of the metal-free phthalocyanine, the resulting mixture was subjected to an acid pasting treatment with 96% sulfuric acid, then washed with water and dried to obtain a metal-free phthalocyanine containing a ligand-bonded metal phthalocyanine compound.

Example 17

A photoconductor was fabricated in the same manner as in Example 16 except that the quantity of the ligand-bonded metal phthalocyanine compound added to 1 mol of the metal-free phthalocyanine was changed to 10 $\mu$mol.

Example 18

A photoconductor was fabricated in the same manner as in Example 16 except that the quantity of the ligand-bonded metal phthalocyanine compound added to 1 mol of the metal-free phthalocyanine was changed to 1 mmol.

Example 19

A photoconductor was fabricated in the same manner as in Example 16 except that the quantity of the ligand-bonded metal phthalocyanine compound added to 1 mol of the metal-free phthalocyanine was changed to 100 mmol.

Example 20

A photoconductor was fabricated in the same manner as in Example 16 except that the quantity of the ligand-bonded metal phthalocyanine compound added to 1 mol of the metal-free phthalocyanine was changed to 200 mmol.

Comparative Example 5

A photoconductor was fabricated in the same manner as in Example 1 except that the quantity of the ligand-bonded metal phthalocyanine compound added to 1 mol of the metal-free phthalocyanine was changed to 50 nmol.

Comparative Example 6

A photoconductor was fabricated in the same manner as in Example 11 except that the quantity of the ligand-bonded metal phthalocyanine compound added to 1 mol of the metal-free phthalocyanine was changed to 300 mmol.

Comparative Example 7

A photoconductor was fabricated in the same manner as in Example 16 except that the quantity of the ligand-bonded metal phthalocyanine compound added to 1 mol of the metal-free phthalocyanine was changed to 50 nmol.

Comparative Example 8

A photoconductor was fabricated in the same manner as in Example 16 except that the quantity of the ligand-bonded metal phthalocyanine compound added to 1 mol of the metal-free phthalocyanine was changed to 300 mmol.

An electric characteristic of each of the photoconductors from Examples 11 to 20 and Comparative Examples 5 to 8 was measured in the same manner as in the above-described Examples and Comparative Examples. The results of the charge retention rate measurement are shown in Table 2.

TABLE 2

| specimen | retention rate % | Specimen | retention rate % |
|---|---|---|---|
| Example 11 | 96.2 | Comp. Example 5 | 89.8 |
| Example 12 | 96.7 | Comp. Example 6 | 89.1 |
| Example 13 | 96.6 | Comp. Example 7 | 89.6 |
| Example 14 | 96.2 | Comp. Example 8 | 88.8 |
| Example 15 | 96.0 | | |
| Example 16 | 96.5 | | |
| Example 17 | 96.4 | | |
| Example 18 | 96.4 | | |
| Example 19 | 95.9 | | |
| Example 20 | 96.2 | | |

It is apparent from Table 2 that the potential retention rates of all Examples are high and favorable, while the potential retention rates of all Comparative Examples are lower in comparison with those of Examples.

Example 21

A photoconductor was fabricated in the same manner as in Example 1 except that the titanyloxophthalocyanine was replaced by vanadium phthalocyanine synthesized according to a common method.

Example 22

A photoconductor was fabricated in the same manner as in Example 21 except that the quantity of the ligand-bonded metal phthalocyanine compound added to 1 mol of the vanadium phthalocyanine was changed to 10 $\mu$mol.

Example 23

A photoconductor was fabricated in the same manner as in Example 21 except that the quantity of the ligand-bonded metal phthalocyanine compound added to 1 mol of the vanadium phthalocyanine was changed to 1 mmol.

Example 24

A photoconductor was fabricated in the same manner as in Example 21 except that the quantity of the ligand-bonded metal phthalocyanine compound added to 1 mol of the vanadium phthalocyanine was changed to 100 mmol.

Example 25

A photoconductor was fabricated in the same manner as in Example 21 except that the quantity of the ligand-bonded metal phthalocyanine compound added to 1 mol of the vanadium phthalocyanine was changed to 200 mmol.

Example 26

A photoconductor was fabricated in the same manner as in Example 21 except that after adding 100 nmol of the ligand-bonded metal phthalocyanine compound to 1 mol of the vanadium phthalocyanine, the resulting mixture was subjected to an acid pasting treatment with 96% sulfuric acid, then washed with water and dried to obtain a vanadium phthalocyanine containing a ligand-bonded metal phthalocyanine compound.

Example 27

A photoconductor was fabricated in the same manner as in Example 26 except that the quantity of the ligand-bonded metal phthalocyanine compound added to 1 mol of the vanadium phthalocyanine was changed to 10 $\mu$mol.

Example 28

A photoconductor was fabricated in the same manner as in Example 26 except that the quantity of the ligand-bonded metal phthalocyanine compound added to 1 mol of the vanadium phthalocyanine was changed to 1 mmol.

Example 29

A photoconductor was fabricated in the same manner as in Example 26 except that the quantity of the ligand-bonded metal phthalocyanine compound added to 1 mol of the vanadium phthalocyanine was changed to 100 mmol.

Example 30

A photoconductor was fabricated in the same manner as in Example 26 except that the quantity of the ligand-bonded metal phthalocyanine compound added to 1 mol of the vanadium phthalocyanine was changed to 200 mmol.

Comparative Example 9

A photoconductor was fabricated in the same manner as in Example 21 except that the quantity of the ligand-bonded metal phthalocyanine compound added to 1 mol of the vanadium phthalocyanine was changed to 50 nmol.

Comparative Example 10

A photoconductor was fabricated in the same manner as in Example 21 except that the quantity of the ligand-bonded metal phthalocyanine compound added to 1 mol of the vanadium phthalocyanine was changed to 300 mmol.

Comparative Example 11

A photoconductor was fabricated in the same manner as in Example 26 except that the quantity of the ligand-bonded metal phthalocyanine compound added to 1 mol of the vanadium phthalocyanine was changed to 50 nmol.

Comparative Example 12

A photoconductor was fabricated in the same manner as in Example 26 except that the quantity of the ligand-bonded metal phthalocyanine compound added to 1 mol of the vanadium phthalocyanine was changed to 300 mmol.

An electric characteristic of each of the photoconductors from Examples 21 to 30 and Comparative Examples 9 to 12 was measured in the same manner as in the above-described Examples and Comparative Examples. The results of the charge retention rate measurement are shown in Table 3.

TABLE 3

| specimen | retention rate % | Specimen | retention rate % |
|---|---|---|---|
| Example 21 | 95.2 | Comp. Example 9 | 87.9 |
| Example 22 | 95.1 | Comp. Example 10 | 88.6 |
| Example 23 | 95.3 | Comp. Example 11 | 88.2 |
| Example 24 | 95.0 | Comp. Example 12 | 88.4 |
| Example 25 | 95.1 | | |
| Example 26 | 95.2 | | |
| Example 27 | 94.9 | | |
| Example 28 | 95.2 | | |
| Example 29 | 95.0 | | |
| Example 30 | 95.1 | | |

It is apparent from Table 3 that the potential retention rates of all Examples are high and favorable, while the potential retention rates of all Comparative Examples are lower in comparison with those of Examples.

Example 31

A photoconductor was fabricated in the same manner as in Example 1 except that the titanyloxophthalocyanine was replaced by niobium phthalocyanine synthesized according to a common method.

Example 32

A photoconductor was fabricated in the same manner as in Example 31 except that the quantity of the ligand-bonded metal phthalocyanine compound added to 1 mol of the niobium phthalocyanine was changed to 10 $\mu$mol.

Example 33

A photoconductor was fabricated in the same manner as in Example 31 except that the quantity of the ligand-bonded metal phthalocyanine compound added to 1 mol of the niobium phthalocyanine was changed to 1 mmol.

Example 34

A photoconductor was fabricated in the same manner as in Example 31 except that the quantity of the ligand-bonded metal phthalocyanine compound added to 1 mol of the niobium phthalocyanine was changed to 100 mmol.

Example 35

A photoconductor was fabricated in the same manner as in Example 31 except that the quantity of the ligand-bonded metal phthalocyanine compound added to 1 mol of the niobium phthalocyanine was changed to 200 mmol.

Example 36

A photoconductor was fabricated in the same manner as in Example 31 except that after adding 100 nmol of the ligand-bonded metal phthalocyanine compound to 1 mol of the niobium phthalocyanine, the resulting mixture was subjected to an acid pasting treatment with 96% sulfuric acid, then washed with water and dried to obtain a niobium phthalocyanine containing a ligand-bonded metal phthalocyanine compound.

Example 37

A photoconductor was fabricated in the same manner as in Example 36 except that the quantity of the ligand-bonded metal phthalocyanine compound added to 1 mol of the niobium phthalocyanine was changed to 10 $\mu$mol.

Example 38

A photoconductor was fabricated in the same manner as in Example 36 except that the quantity of the ligand-bonded metal phthalocyanine compound added to 1 mol of the niobium phthalocyanine was changed to 1 mmol.

Example 39

A photoconductor was fabricated in the same manner as in Example 36 except that the quantity of the ligand-bonded metal phthalocyanine compound added to 1 mol of the niobium phthalocyanine was changed to 100 mmol.

Example 40

A photoconductor was fabricated in the same manner as in Example 36 except that the quantity of the ligand-bonded metal phthalocyanine compound added to 1 mol of the niobium phthalocyanine was changed to 200 mmol.

Comparative Example 13

A photoconductor was fabricated in the same manner as in Example 31 except that the quantity of the ligand-bonded metal phthalocyanine compound added to 1 mol of the niobium phthalocyanine was changed to 50 nmol.

Comparative Example 14

A photoconductor was fabricated in the same manner as in Example 31 except that the quantity of the ligand-bonded metal phthalocyanine compound added to 1 mol of the niobium phthalocyanine was changed to 300 mmol.

Comparative Example 15

A photoconductor was fabricated in the same manner as in Example 36 except that the quantity of the ligand-bonded metal phthalocyanine compound added to 1 mol of the niobium phthalocyanine was changed to 50 nmol.

Comparative Example 16

A photoconductor was fabricated in the same manner as in Example 36 except that the quantity of the ligand-bonded metal phthalocyanine compound added to 1 mol of the niobium phthalocyanine was changed to 300 mmol.

An electric characteristic of each of the photoconductors from Examples 31 to 40 and Comparative Examples 13 to 16 was measured in the same manner as in the above-described Examples and Comparative Examples. The results of the charge retention rate measurement are shown in Table 4.

TABLE 4

| specimen | retention rate % | Specimen | retention rate % |
|---|---|---|---|
| Example 31 | 95.2 | Comp. Example 13 | 89.2 |
| Example 32 | 94.8 | Comp. Example 14 | 88.4 |
| Example 33 | 95.2 | Comp. Example 15 | 88.2 |
| Example 34 | 95.0 | Comp. Example 16 | 87.4 |
| Example 35 | 95.1 | | |
| Example 36 | 95.3 | | |
| Example 37 | 94.9 | | |
| Example 38 | 95.0 | | |
| Example 39 | 95.3 | | |
| Example 40 | 95.2 | | |

It is apparent from Table 4 that the potential retention rates of all Examples are high and favorable, while the potential retention rates of all Comparative Examples are lower in comparison with those of Examples.

Example 41

A photoconductor was fabricated in the same manner as in Example 1 except that the titanyloxophthalocyanine was replaced by indium phthalocyanine synthesized according to a common method.

Example 42

A photoconductor was fabricated in the same manner as in Example 41 except that the quantity of the ligand-bonded metal phthalocyanine compound added to 1 mol of the indium phthalocyanine was changed to 10 μmol.

Example 43

A photoconductor was fabricated in the same manner as in Example 41 except that the quantity of the ligand-bonded metal phthalocyanine compound added to 1 mol of the indium phthalocyanine was changed to 1 mmol.

Example 44

A photoconductor was fabricated in the same manner as in Example 41 except that the quantity of the ligand-bonded metal phthalocyanine compound added to 1 mol of the indium phthalocyanine was changed to 100 mmol.

Example 45

A photoconductor was fabricated in the same manner as in Example 41 except that the quantity of the ligand-bonded metal phthalocyanine compound added to 1 mol of the indium phthalocyanine was changed to 200 mmol.

Example 46

A photoconductor was fabricated in the same manner as in Example 41 except that after adding 100 nmol of the ligand-bonded metal phthalocyanine compound to 1 mol of the indium phthalocyanine, the resulting mixture was subjected to an acid pasting treatment with 96% sulfuric acid, then washed with water and dried to obtain a indium phthalocyanine containing a ligand-bonded metal phthalocyanine compound.

Example 47

A photoconductor was fabricated in the same manner as in Example 46 except that the quantity of the ligand-bonded metal phthalocyanine compound added to 1 mol of the indium phthalocyanine was changed to 10 μmol.

Example 48

A photoconductor was fabricated in the same manner as in Example 46 except that the quantity of the ligand-bonded metal phthalocyanine compound added to 1 mol of the indium phthalocyanine was changed to 1 mmol.

Example 49

A photoconductor was fabricated in the same manner as in Example 46 except that the quantity of the ligand-bonded metal phthalocyanine compound added to 1 mol of the indium phthalocyanine was changed to 100 mmol.

Example 50

A photoconductor was fabricated in the same manner as in Example 46 except that the quantity of the ligand-bonded metal phthalocyanine compound added to 1 mol of the indium phthalocyanine was changed to 200 mmol.

Comparative Example 17

A photoconductor was fabricated in the same manner as in Example 41 except that the quantity of the ligand-bonded metal phthalocyanine compound added to 1 mol of the indium phthalocyanine was changed to 50 nmol.

Comparative Example 18

A photoconductor was fabricated in the same manner as in Example 41 except that the quantity of the ligand-bonded metal phthalocyanine compound added to 1 mol of the indium phthalocyanine was changed to 300 mmol.

Comparative Example 19

A photoconductor was fabricated in the same manner as in Example 46 except that the quantity of the ligand-bonded metal phthalocyanine compound added to 1 mol of the indium phthalocyanine was changed to 50 nmol.

Comparative Example 20

A photoconductor was fabricated in the same manner as in Example 46 except that the quantity of the ligand-bonded metal phthalocyanine compound added to 1 mol of the indium phthalocyanine was changed to 300 mmol.

An electric characteristic of each of the photoconductors from Examples 41 to 50 and Comparative Examples 17 to 20 was measured in the same manner as in the above-described Examples and Comparative Examples. The results of the charge retention rate measurement are shown in Table 5.

TABLE 5

| specimen | retention rate % | Specimen | retention rate % |
|---|---|---|---|
| Example 41 | 95.6 | Comp. Example 17 | 89.2 |
| Example 42 | 95.8 | Comp. Example 18 | 89.0 |
| Example 43 | 95.1 | Comp. Example 19 | 89.6 |
| Example 44 | 95.5 | Comp. Example 20 | 89.4 |
| Example 45 | 95.3 | | |
| Example 46 | 95.3 | | |
| Example 47 | 95.5 | | |
| Example 48 | 95.2 | | |
| Example 49 | 95.0 | | |
| Example 50 | 95.3 | | |

It is apparent from Table 5 that the potential retention rates of all Examples are high and favorable, while the potential retention rates of all Comparative Examples are lower in comparison with those of Examples.

Example 51

A photoconductor was fabricated in the same manner as in Example 1 except that the titanyloxophthalocyanine was replaced by gallium phthalocyanine synthesized according to a common method.

Example 52

A photoconductor was fabricated in the same manner as in Example 51 except that the quantity of the ligand-bonded metal phthalocyanine compound added to 1 mol of the gallium phthalocyanine was changed to 10 μmol.

Example 53

A photoconductor was fabricated in the same manner as in Example 51 except that the quantity of the ligand-bonded metal phthalocyanine compound added to 1 mol of the gallium phthalocyanine was changed to 1 mmol.

Example 54

A photoconductor was fabricated in the same manner as in Example 51 except that the quantity of the ligand-bonded metal phthalocyanine compound added to 1 mol of the gallium phthalocyanine was changed to 100 mmol.

Example 55

A photoconductor was fabricated in the same manner as in Example 51 except that the quantity of the ligand-bonded metal phthalocyanine compound added to 1 mol of the gallium phthalocyanine was changed to 200 mmol.

Example 56

A photoconductor was fabricated in the same manner as in Example 51 except that after adding 100 nmol of the ligand-bonded metal phthalocyanine compound to 1 mol of the gallium phthalocyanine, the resulting mixture was subjected to an acid pasting treatment with 96% sulfuric acid, then washed with water and dried to obtain a gallium phthalocyanine containing a ligand-bonded metal phthalocyanine compound.

Example 57

A photoconductor was fabricated in the same manner as in Example 56 except that the quantity of the ligand-bonded metal phthalocyanine compound added to 1 mol of the gallium phthalocyanine was changed to 10 $\mu$mol.

Example 58

A photoconductor was fabricated in the same manner as in Example 56 except that the quantity of the ligand-bonded metal phthalocyanine compound added to 1 mol of the gallium phthalocyanine was changed to 1 mmol.

Example 59

A photoconductor was fabricated in the same manner as in Example 56 except that the quantity of the ligand-bonded metal phthalocyanine compound added to 1 mol of the gallium phthalocyanine was changed to 100 mmol.

Example 60

A photoconductor was fabricated in the same manner as in Example 56 except that the quantity of the ligand-bonded metal phthalocyanine compound added to 1 mol of the gallium phthalocyanine was changed to 200 mmol.

Comparative Example 21

A photoconductor was fabricated in the same manner as in Example 51 except that the quantity of the ligand-bonded metal phthalocyanine compound added to 1 mol of the gallium phthalocyanine was changed to 50 nmol.

Comparative Example 22

A photoconductor was fabricated in the same manner as in Example 51 except that the quantity of the ligand-bonded metal phthalocyanine compound added to 1 mol of the gallium phthalocyanine was changed to 300 mmol.

Comparative Example 23

A photoconductor was fabricated in the same manner as in Example 56 except that the quantity of the ligand-bonded metal phthalocyanine compound added to 1 mol of the gallium phthalocyanine was changed to 50 nmol.

Comparative Example 24

A photoconductor was fabricated in the same manner as in Example 56 except that the quantity of the ligand-bonded metal phthalocyanine compound added to 1 mol of the gallium phthalocyanine was changed to 300 mmol.

An electric characteristic of each of the photoconductors from Examples 51 to 60 and Comparative Examples 21 to 24 was measured in the same manner as in the above-described Examples and Comparative Examples. The results of the charge retention rate measurement are shown in Table 6.

TABLE 6

| specimen | retention rate % | Specimen | retention rate % |
|---|---|---|---|
| Example 51 | 95.5 | Comp. Example 21 | 89.4 |
| Example 52 | 95.3 | Comp. Example 22 | 88.7 |
| Example 53 | 95.0 | Comp. Example 23 | 89.8 |
| Example 54 | 95.3 | Comp. Example 24 | 89.0 |
| Example 55 | 95.1 | | |
| Example 56 | 95.4 | | |
| Example 57 | 94.9 | | |
| Example 58 | 95.2 | | |
| Example 59 | 95.3 | | |
| Example 60 | 95.1 | | |

It is apparent from Table 6 that the potential retention rates of all Examples are high and favorable, while the potential retention rates of all Comparative Examples are lower in comparison with those of Examples.

Example 61

A photoconductor was fabricated in the same manner as in Example 1 except that the titanyloxophthalocyanine was replaced by zirconium phthalocyanine synthesized according to a common method.

Example 62

A photoconductor was fabricated in the same manner as in Example 61 except that the quantity of the ligand-bonded metal phthalocyanine compound added to 1 mol of the zirconium phthalocyanine was changed to 10 $\mu$mol.

Example 63

A photoconductor was fabricated in the same manner as in Example 61 except that the quantity of the ligand-bonded metal phthalocyanine compound added to 1 mol of the zirconium phthalocyanine was changed to 1 mmol.

Example 64

A photoconductor was fabricated in the same manner as in Example 61 except that the quantity of the ligand-bonded metal phthalocyanine compound added to 1 mol of the zirconium phthalocyanine was changed to 100 mmol.

Example 65

A photoconductor was fabricated in the same manner as in Example 61 except that the quantity of the ligand-bonded metal phthalocyanine compound added to 1 mol of the zirconium phthalocyanine was changed to 200 mmol.

Example 66

A photoconductor was fabricated in the same manner as in Example 61 except that after adding 100 nmol of the ligand-bonded metal phthalocyanine compound to 1 mol of the zirconium phthalocyanine, the resulting mixture was subjected to an acid pasting treatment with 96% sulfuric acid, then washed with water and dried to obtain a zirconium phthalocyanine containing a ligand-bonded metal phthalocyanine compound.

Example 67

A photoconductor was fabricated in the same manner as in Example 66 except that the quantity of the ligand-bonded metal phthalocyanine compound added to 1 mol of the zirconium phthalocyanine was changed to 10 μmol.

Example 68

A photoconductor was fabricated in the same manner as in Example 66 except that the quantity of the ligand-bonded metal phthalocyanine compound added to 1 mol of the zirconium phthalocyanine was changed to 1 mmol.

Example 69

A photoconductor was fabricated in the same manner as in Example 66 except that the quantity of the ligand-bonded metal phthalocyanine compound added to 1 mol of the zirconium phthalocyanine was changed to 100 mmol.

Example 70

A photoconductor was fabricated in the same manner as in Example 66 except that the quantity of the ligand-bonded metal phthalocyanine compound added to 1 mol of the zirconium phthalocyanine was changed to 200 mmol.

Comparative Example 25

A photoconductor was fabricated in the same manner as in Example 61 except that the quantity of the ligand-bonded metal phthalocyanine compound added to 1 mol of the zirconium phthalocyanine was changed to 50 nmol.

Comparative Example 26

A photoconductor was fabricated in the same manner as in Example 61 except that the quantity of the ligand-bonded metal phthalocyanine compound added to 1 mol of the zirconium phthalocyanine was changed to 300 mmol.

Comparative Example 27

A photoconductor was fabricated in the same manner as in Example 66 except that the quantity of the ligand-bonded metal phthalocyanine compound added to 1 mol of the zirconium phthalocyanine was changed to 50 nmol.

Comparative Example 28

A photoconductor was fabricated in the same manner as in Example 66 except that the quantity of the ligand-bonded metal phthalocyanine compound added to 1 mol of the zirconium phthalocyanine was changed to 300 mmol.

An electric characteristic of each of the photoconductors from Examples 61 to 70 and Comparative Examples 25 to 28 was measured in the same manner as in the above-described Examples and Comparative Examples. The results of the charge retention rate measurement are shown in Table 7.

TABLE 7

| specimen | retention rate % | Specimen | retention rate % |
|---|---|---|---|
| Example 61 | 95.1 | Comp. Example 25 | 88.8 |
| Example 62 | 95.5 | Comp. Example 26 | 89.0 |
| Example 63 | 95.3 | Comp. Example 27 | 89.2 |
| Example 64 | 95.5 | Comp. Example 28 | 88.7 |
| Example 65 | 95.2 | | |
| Example 66 | 95.6 | | |
| Example 67 | 95.1 | | |
| Example 68 | 95.4 | | |
| Example 69 | 95.3 | | |
| Example 70 | 95.1 | | |

It is apparent from Table 7 that the potential retention rates of all Examples are high and favorable, while the potential retention rates of all Comparative Examples are lower in comparison with those of Examples.

Example 71

A photoconductor was fabricated in the same manner as in Example 1 except that the titanyloxophthalocyanine was replaced by germanium phthalocyanine synthesized according to a common method.

Example 72

A photoconductor was fabricated in the same manner as in Example 71 except that the quantity of the ligand-bonded metal phthalocyanine compound added to 1 mol of the germanium phthalocyanine was changed to 10 μmol.

Example 73

A photoconductor was fabricated in the same manner as in Example 71 except that the quantity of the ligand-bonded metal phthalocyanine compound added to 1 mol of the germanium phthalocyanine was changed to 1 mmol.

Example 74

A photoconductor was fabricated in the same manner as in Example 71 except that the quantity of the ligand-bonded metal phthalocyanine compound added to 1 mol of the germanium phthalocyanine was changed to 100 mmol.

Example 75

A photoconductor was fabricated in the same manner as in Example 71 except that the quantity of the ligand-bonded metal phthalocyanine compound added to 1 mol of the germanium phthalocyanine was changed to 200 mmol.

Example 76

A photoconductor was fabricated in the same manner as in Example 71 except that after adding 100 nmol of the ligand-bonded metal phthalocyanine compound to 1 mol of the germanium phthalocyanine, the resulting mixture was subjected to an acid pasting treatment with 96% sulfuric acid, then washed with water and dried to obtain a germanium phthalocyanine containing a ligand-bonded metal phthalocyanine compound.

Example 77

A photoconductor was fabricated in the same manner as in Example 76 except that the quantity of the ligand-bonded metal phthalocyanine compound added to 1 mol of the germanium phthalocyanine was changed to 10 μmol.

Example 78

A photoconductor was fabricated in the same manner as in Example 76 except that the quantity of the ligand-bonded metal phthalocyanine compound added to 1 mol of the germanium phthalocyanine was changed to 1 mmol.

Example 79

A photoconductor was fabricated in the same manner as in Example 76 except that the quantity of the ligand-bonded metal phthalocyanine compound added to 1 mol of the germanium phthalocyanine was changed to 100 mmol.

Example 80

A photoconductor was fabricated in the same manner as in Example 76 except that the quantity of the ligand-bonded metal phthalocyanine compound added to 1 mol of the germanium phthalocyanine was changed to 200 mmol.

Comparative Example 29

A photoconductor was fabricated in the same manner as in Example 71 except that the quantity of the ligand-bonded metal phthalocyanine compound added to 1 mol of the germanium phthalocyanine was changed to 50 nmol.

Comparative Example 30

A photoconductor was fabricated in the same manner as in Example 71 except that the quantity of the ligand-bonded metal phthalocyanine compound added to 1 mol of the germanium phthalocyanine was changed to 300 mmol.

Comparative Example 31

A photoconductor was fabricated in the same manner as in Example 76 except that the quantity of the ligand-bonded metal phthalocyanine compound added to 1 mol of the germanium phthalocyanine was changed to 50 nmol.

Comparative Example 32

A photoconductor was fabricated in the same manner as in Example 76 except that the quantity of the ligand-bonded metal phthalocyanine compound added to 1 mol of the germanium phthalocyanine was changed to 300 mmol.

An electric characteristic of each of the photoconductors from Examples 71 to 80 and Comparative Examples 29 to 32 was measured in the same manner as in the above-described Examples and Comparative Examples. The results of the charge retention rate measurement are shown in Table 8.

TABLE 8

| Specimen | retention rate % | Specimen | retention rate % |
|---|---|---|---|
| Example 71 | 95.4 | Comp. Example 29 | 88.3 |
| Example 72 | 95.1 | Comp. Example 30 | 87.7 |
| Example 73 | 95.3 | Comp. Example 31 | 88.2 |
| Example 74 | 95.0 | Comp. Example 32 | 88.0 |
| Example 75 | 95.1 | | |
| Example 76 | 95.2 | | |
| Example 77 | 94.9 | | |
| Example 78 | 95.0 | | |
| Example 79 | 95.2 | | |
| Example 80 | 95.2 | | |

It is apparent from Table 8 that the potential retention rates of all Examples are high and favorable, while the potential retention rates of all Comparative Examples are lower in comparison with those of Examples.

Example 81

A photoconductor was fabricated in the same manner as in Example 1 except that the titanyloxophthalocyanine was replaced by iron(II)-1,2,3,4,8,9,10,11,15,16,17,18,22,23,24,25-hexadecafluoro-29H,31H-phthalocyanine (hereinafter, simply called "fluoroiron phthalocyanine") synthesized according to a common method.

Example 82

A photoconductor was fabricated in the same manner as in Example 81 except that the quantity of the ligand-bonded metal phthalocyanine compound added to 1 mol of the fluoroiron phthalocyanine was changed to 10 $\mu$mol.

Example 83

A photoconductor was fabricated in the same manner as in Example 81 except that the quantity of the ligand-bonded metal phthalocyanine compound added to 1 mol of the fluoroiron phthalocyanine was changed to 1 mmol.

Example 84

A photoconductor was fabricated in the same manner as in Example 81 except that the quantity of the ligand-bonded metal phthalocyanine compound added to 1 mol of the fluoroiron phthalocyanine was changed to 100 mmol.

Example 85

A photoconductor was fabricated in the same manner as in Example 81 except that the quantity of the ligand-bonded metal phthalocyanine compound added to 1 mol of the fluoroiron phthalocyanine was changed to 200 mmol.

Example 86

A photoconductor was fabricated in the same manner as in Example 81 except that after adding 100 nmol of the ligand-bonded metal phthalocyanine compound to 1 mol of the fluoroiron phthalocyanine, the resulting mixture was subjected to an acid pasting treatment with 96% sulfuric acid, then washed with water and dried to obtain a fluoroiron phthalocyanine containing a ligand-bonded metal phthalocyanine compound.

Example 87

A photoconductor was fabricated in the same manner as in Example 86 except that the quantity of the ligand-bonded metal phthalocyanine compound added to 1 mol of the fluoroiron phthalocyanine was changed to 10 $\mu$mol.

Example 88

A photoconductor was fabricated in the same manner as in Example 86 except that the quantity of the ligand-bonded metal phthalocyanine compound added to 1 mol of the fluoroiron phthalocyanine was changed to 1 mmol.

Example 89

A photoconductor was fabricated in the same manner as in Example 86 except that the quantity of the ligand-bonded metal phthalocyanine compound added to 1 mol of the fluoroiron phthalocyanine was changed to 100 mmol.

Example 90

A photoconductor was fabricated in the same manner as in Example 86 except that the quantity of the ligand-bonded metal phthalocyanine compound added to 1 mol of the fluoroiron phthalocyanine was changed to 200 mmol.

Comparative Example 33

A photoconductor was fabricated in the same manner as in Example 81 except that the quantity of the ligand-bonded metal phthalocyanine compound added to 1 mol of the fluoroiron phthalocyanine was changed to 50 nmol.

Comparative Example 34

A photoconductor was fabricated in the same manner as in Example 81 except that the quantity of the ligand-bonded metal phthalocyanine compound added to 1 mol of the fluoroiron phthalocyanine was changed to 300 mmol.

Comparative Example 35

A photoconductor was fabricated in the same manner as in Example 86 except that the quantity of the ligand-bonded metal phthalocyanine compound added to 1 mol of the fluoroiron phthalocyanine was changed to 50 nmol.

Comparative Example 36

A photoconductor was fabricated in the same manner as in Example 86 except that the quantity of the ligand-bonded metal phthalocyanine compound added to 1 mol of the fluoroiron phthalocyanine was changed to 300 mmol.

An electric characteristic of each of the photoconductors from Examples 81 to 90 and Comparative Examples 33 to 36 was measured in the same manner as in the above-described Examples and Comparative Examples. The results of the charge retention rate measurement are shown in Table 9.

TABLE 9

| specimen | retention rate % | Specimen | retention rate % |
|---|---|---|---|
| Example 81 | 95.7 | Comp. Example 33 | 88.7 |
| Example 82 | 96.0 | Comp. Example 34 | 87.9 |
| Example 83 | 95.5 | Comp. Example 35 | 89.0 |
| Example 84 | 95.1 | Comp. Example 36 | 88.4 |
| Example 85 | 95.2 | | |
| Example 86 | 95.7 | | |
| Example 87 | 95.5 | | |
| Example 88 | 95.8 | | |
| Example 89 | 95.2 | | |
| Example 90 | 95.4 | | |

It is apparent from Table 9 that the potential retention rates of all Examples are high and favorable, while the potential retention rates of all Comparative Examples are lower in comparison with those of Examples.

Example 91

A photoconductor was fabricated in the same manner as in Example 1 except that the titanyloxophthalocyanine was replaced by tin phthalocyanine synthesized according to a common method.

Example 92

A photoconductor was fabricated in the same manner as in Example 91 except that the quantity of the ligand-bonded metal phthalocyanine compound added to 1 mol of the tin phthalocyanine was changed to 10 $\mu$mol.

Example 93

A photoconductor was fabricated in the same manner as in Example 91 except that the quantity of the ligand-bonded metal phthalocyanine compound added to 1 mol of the tin phthalocyanine was changed to 1 mmol.

Example 94

A photoconductor was fabricated in the same manner as in Example 91 except that the quantity of the ligand-bonded metal phthalocyanine compound added to 1 mol of the tin phthalocyanine was changed to 100 mmol.

Example 95

A photoconductor was fabricated in the same manner as in Example 91 except that the quantity of the ligand-bonded metal phthalocyanine compound added to 1 mol of the tin phthalocyanine was changed to 200 mmol.

Example 96

A photoconductor was fabricated in the same manner as in Example 91 except that after adding 100 nmol of the ligand-bonded metal phthalocyanine compound to 1 mol of the tin phthalocyanine, the resulting mixture was subjected to an acid pasting treatment with 96% sulfuric acid, then washed with water and dried to obtain a tin phthalocyanine containing a ligand-bonded metal phthalocyanine compound.

Example 97

A photoconductor was fabricated in the same manner as in Example 96 except that the quantity of the ligand-bonded metal phthalocyanine compound added to 1 mol of the tin phthalocyanine was changed to 10 $\mu$mol.

Example 98

A photoconductor was fabricated in the same manner as in Example 96 except that the quantity of the ligand-bonded metal phthalocyanine compound added to 1 mol of the tin phthalocyanine was changed to 1 mmol.

Example 99

A photoconductor was fabricated in the same manner as in Example 96 except that the quantity of the ligand-bonded metal phthalocyanine compound added to 1 mol of the tin phthalocyanine was changed to 100 mmol.

Example 100

A photoconductor was fabricated in the same manner as in Example 96 except that the quantity of the ligand-bonded metal phthalocyanine compound added to 1 mol of the tin phthalocyanine was changed to 200 mmol.

Comparative Example 37

A photoconductor was fabricated in the same manner as in Example 91 except that the quantity of the ligand-bonded metal phthalocyanine compound added to 1 mol of the tin phthalocyanine was changed to 50 nmol.

Comparative Example 38

A photoconductor was fabricated in the same manner as in Example 91 except that the quantity of the ligand-bonded metal phthalocyanine compound added to 1 mol of the tin phthalocyanine was changed to 300 mmol.

Comparative Example 39

A photoconductor was fabricated in the same manner as in Example 96 except that the quantity of the ligand-bonded metal phthalocyanine compound added to 1 mol of the tin phthalocyanine was changed to 50 nmol.

Comparative Example 40

A photoconductor was fabricated in the same manner as in Example 96 except that the quantity of the ligand-bonded metal phthalocyanine compound added to 1 mol of the tin phthalocyanine was changed to 300 mmol.

An electric characteristic of each of the photoconductors from Examples 91 to 100 and Comparative Examples 37 to 40 was measured in the same manner as in the above-described Examples and Comparative Examples. The results of the charge retention rate measurement are shown in Table 10.

TABLE 10

| specimen | retention rate % | Specimen | retention rate % |
|---|---|---|---|
| Example 91 | 95.0 | Comp. Example 37 | 87.9 |
| Example 92 | 94.8 | Comp. Example 38 | 87.1 |
| Example 93 | 94.7 | Comp. Example 39 | 88.0 |
| Example 94 | 94.9 | Comp. Example 40 | 87.4 |
| Example 95 | 94.6 | | |
| Example 96 | 94.8 | | |
| Example 97 | 94.9 | | |
| Example 98 | 95.0 | | |
| Example 99 | 94.8 | | |
| Example 100 | 94.6 | | |

It is apparent from Table 10 that the potential retention rates of all Examples are high and favorable, while the potential retention rates of all Comparative Examples are lower in comparison with those of Examples.

Example 101

A photoconductor was fabricated in the same manner as in Example 1 except that the titanyloxophthalocyanine was replaced by manganese phthalocyanine synthesized according to a common method.

Example 102

A photoconductor was fabricated in the same manner as in Example 101 except that the quantity of the ligand-bonded metal phthalocyanine compound added to 1 mol of the manganese phthalocyanine was changed to 10 $\mu$mol.

Example 103

A photoconductor was fabricated in the same manner as in Example 101 except that the quantity of the ligand-bonded metal phthalocyanine compound added to 1 mol of the manganese phthalocyanine was changed to 1 mmol.

Example 104

A photoconductor was fabricated in the same manner as in Example 101 except that the quantity of the ligand-bonded metal phthalocyanine compound added to 1 mol of the manganese phthalocyanine was changed to 100 mmol.

Example 105

A photoconductor was fabricated in the same manner as in Example 101 except that the quantity of the ligand-bonded metal phthalocyanine compound added to 1 mol of the manganese phthalocyanine was changed to 200 mmol.

Example 106

A photoconductor was fabricated in the same manner as in Example 101 except that after adding 100 nmol of the ligand-bonded metal phthalocyanine compound to 1 mol of the manganese phthalocyanine, the resulting mixture was subjected to an acid pasting treatment with 96% sulfuric acid, then washed with water and dried to obtain a manganese phthalocyanine containing a ligand-bonded metal phthalocyanine compound.

Example 107

A photoconductor was fabricated in the same manner as in Example 106 except that the quantity of the ligand-bonded metal phthalocyanine compound added to 1 mol of the manganese phthalocyanine was changed to 10 $\mu$mol.

Example 108

A photoconductor was fabricated in the same manner as in Example 106 except that the quantity of the ligand-bonded metal phthalocyanine compound added to 1 mol of the manganese phthalocyanine was changed to 1 mmol.

Example 109

A photoconductor was fabricated in the same manner as in Example 106 except that the quantity of the ligand-bonded metal phthalocyanine compound added to 1 mol of the manganese phthalocyanine was changed to 100 mmol.

Example 110

A photoconductor was fabricated in the same manner as in Example 106 except that the quantity of the ligand-bonded metal phthalocyanine compound added to 1 mol of the manganese phthalocyanine was changed to 200 mmol.

Comparative Example 41

A photoconductor was fabricated in the same manner as in Example 101 except that the quantity of the ligand-bonded metal phthalocyanine compound added to 1 mol of the manganese phthalocyanine was changed to 50 nmol.

Comparative Example 42

A photoconductor was fabricated in the same manner as in Example 101 except that the quantity of the ligand-bonded metal phthalocyanine compound added to 1 mol of the manganese phthalocyanine was changed to 300 mmol.

Comparative Example 43

A photoconductor was fabricated in the same manner as in Example 106 except that the quantity of the ligand-bonded metal phthalocyanine compound added to 1 mol of the manganese phthalocyanine was changed to 50 nmol.

Comparative Example 44

A photoconductor was fabricated in the same manner as in Example 106 except that the quantity of the ligand-bonded metal phthalocyanine compound added to 1 mol of the manganese phthalocyanine was changed to 300 mmol.

An electric characteristic of each of the photoconductors from Examples 101 to 110 and Comparative Examples 41 to 44 was measured in the same manner as in the above-described Examples and Comparative Examples. The results of the charge retention rate measurement are shown in Table 11.

TABLE 11

| specimen | retention rate % | Specimen | retention rate % |
|---|---|---|---|
| Example 101 | 95.5 | Comp. Example 41 | 87.6 |
| Example 102 | 95.7 | Comp. Example 42 | 86.9 |
| Example 103 | 95.2 | Comp. Example 43 | 87.1 |
| Example 104 | 95.5 | Comp. Example 44 | 87.3 |
| Example 105 | 95.4 | | |
| Example 106 | 95.6 | | |
| Example 107 | 95.5 | | |
| Example 108 | 95.0 | | |
| Example 109 | 95.3 | | |
| Example 110 | 95.1 | | |

It is apparent from Table 11 that the potential retention rates of all Examples are high and favorable, while the potential retention rates of all Comparative Examples are lower in comparison with those of Examples.

Example 111

A photoconductor was fabricated in the same manner as in Example 1 except that the titanyloxophthalocyanine was replaced by aluminum phthalocyanine synthesized according to a common method.

Example 112

A photoconductor was fabricated in the same manner as in Example 111 except that the quantity of the ligand-bonded metal phthalocyanine compound added to 1 mol of the aluminum phthalocyanine was changed to 10 $\mu$mol.

Example 113

A photoconductor was fabricated in the same manner as in Example 111 except that the quantity of the ligand-bonded metal phthalocyanine compound added to 1 mol of the aluminum phthalocyanine was changed to 1 mmol.

Example 114

A photoconductor was fabricated in the same manner as in Example 111 except that the quantity of the ligand-bonded metal phthalocyanine compound added to 1 mol of the aluminum phthalocyanine was changed to 100 mmol.

Example 115

A photoconductor was fabricated in the same manner as in Example 111 except that the quantity of the ligand-bonded metal phthalocyanine compound added to 1 mol of the aluminum phthalocyanine was changed to 200 mmol.

Example 116

A photoconductor was fabricated in the same manner as in Example 111 except that after adding 100 nmol of the ligand-bonded metal phthalocyanine compound to 1 mol of the aluminum phthalocyanine, the resulting mixture was subjected to an acid pasting treatment with 96% sulfuric acid, then washed with water and dried to obtain a aluminum phthalocyanine containing a ligand-bonded metal phthalocyanine compound.

Example 117

A photoconductor was fabricated in the same manner as in Example 116 except that the quantity of the ligand-bonded metal phthalocyanine compound added to 1 mol of the aluminum phthalocyanine was changed to 10 $\mu$mol.

Example 118

A photoconductor was fabricated in the same manner as in Example 116 except that the quantity of the ligand-bonded metal phthalocyanine compound added to 1 mol of the aluminum phthalocyanine was changed to 1 mmol.

Example 119

A photoconductor was fabricated in the same manner as in Example 116 except that the quantity of the ligand-bonded metal phthalocyanine compound added to 1 mol of the aluminum phthalocyanine was changed to 100 mmol.

Example 120

A photoconductor was fabricated in the same manner as in Example 116 except that the quantity of the ligand-bonded metal phthalocyanine compound added to 1 mol of the aluminum phthalocyanine was changed to 200 mmol.

Comparative Example 45

A photoconductor was fabricated in the same manner as in Example 111 except that the quantity of the ligand-bonded metal phthalocyanine compound added to 1 mol of the aluminum phthalocyanine was changed to 50 nmol.

Comparative Example 46

A photoconductor was fabricated in the same manner as in Example 111 except that the quantity of the ligand-bonded metal phthalocyanine compound added to 1 mol of the aluminum phthalocyanine was changed to 300 mmol.

Comparative Example 47

A photoconductor was fabricated in the same manner as in Example 116 except that the quantity of the ligand-bonded metal phthalocyanine compound added to 1 mol of the aluminum phthalocyanine was changed to 50 nmol.

Comparative Example 48

A photoconductor was fabricated in the same manner as in Example 116 except that the quantity of the ligand-bonded metal phthalocyanine compound added to 1 mol of the aluminum phthalocyanine was changed to 300 mmol.

An electric characteristic of each of the photoconductors from Examples 111 to 120 and Comparative Examples 45 to 48 was measured in the same manner as in the above-described Examples and Comparative Examples. The results of the charge retention rate measurement are shown in Table 12.

TABLE 12

| specimen | retention rate % | Specimen | Retention rate % |
|---|---|---|---|
| Example 111 | 94.7 | Comp. Example 45 | 87.3 |
| Example 112 | 94.7 | Comp. Example 46 | 86.8 |
| Example 113 | 94.4 | Comp. Example 47 | 87.2 |
| Example 114 | 94.6 | Comp. Example 48 | 86.7 |
| Example 115 | 94.0 | | |
| Example 116 | 94.9 | | |
| Example 117 | 94.7 | | |
| Example 118 | 94.5 | | |
| Example 119 | 94.2 | | |
| Example 120 | 94.2 | | |

It is apparent from Table 12 that the potential retention rates of all Examples are high and favorable, while the potential retention rates of all Comparative Examples are lower in comparison with those of Examples.

Example 121

A photoconductor was fabricated in the same manner as in Example 1 except that the titanyloxophthalocyanine was replaced by iron phthalocyanine synthesized according to a common method.

Example 122

A photoconductor was fabricated in the same manner as in Example 121 except that the quantity of the ligand-bonded metal phthalocyanine compound added to 1 mol of the iron phthalocyanine was changed to 10 μmol.

Example 123

A photoconductor was fabricated in the same manner as in Example 121 except that the quantity of the ligand-bonded metal phthalocyanine compound added to 1 mol of the iron phthalocyanine was changed to 1 mmol.

Example 124

A photoconductor was fabricated in the same manner as in Example 121 except that the quantity of the ligand-bonded metal phthalocyanine compound added to 1 mol of the iron phthalocyanine was changed to 100 mmol.

Example 125

A photoconductor was fabricated in the same manner as in Example 121 except that the quantity of the ligand-bonded metal phthalocyanine compound added to 1 mol of the iron phthalocyanine was changed to 200 mmol.

Example 126

A photoconductor was fabricated in the same manner as in Example 121 except that after adding 100 nmol of the ligand-bonded metal phthalocyanine compound to 1 mol of the iron phthalocyanine, the resulting mixture was subjected to an acid pasting treatment with 96% sulfuric acid, then washed with water and dried to obtain an iron phthalocyanine containing a ligand-bonded metal phthalocyanine compound.

Example 127

A photoconductor was fabricated in the same manner as in Example 126 except that the quantity of the ligand-bonded metal phthalocyanine compound added to 1 mol of the iron phthalocyanine was changed to 10 μmol.

Example 128

A photoconductor was fabricated in the same manner as in Example 126 except that the quantity of the ligand-bonded metal phthalocyanine compound added to 1 mol of the iron phthalocyanine was changed to 1 mmol.

Example 129

A photoconductor was fabricated in the same manner as in Example 126 except that the quantity of the ligand-bonded metal phthalocyanine compound added to 1 mol of the iron phthalocyanine was changed to 100 mmol.

Example 130

A photoconductor was fabricated in the same manner as in Example 126 except that the quantity of the ligand-bonded metal phthalocyanine compound added to 1 mol of the iron phthalocyanine was changed to 200 mmol.

Comparative Example 49

A photoconductor was fabricated in the same manner as in Example 121 except that the quantity of the ligand-bonded metal phthalocyanine compound added to 1 mol of the iron phthalocyanine was changed to 50 nmol.

Comparative Example 50

A photoconductor was fabricated in the same manner as in Example 121 except that the quantity of the ligand-bonded metal phthalocyanine compound added to 1 mol of the iron phthalocyanine was changed to 300 mmol.

Comparative Example 51

A photoconductor was fabricated in the same manner as in Example 126 except that the quantity of the ligand-bonded metal phthalocyanine compound added to 1 mol of the iron phthalocyanine was changed to 50 nmol.

Comparative Example 52

A photoconductor was fabricated in the same manner as in Example 126 except that the quantity of the ligand-bonded metal phthalocyanine compound added to 1 mol of the iron phthalocyanine was changed to 300 mmol.

An electric characteristic of each of the photoconductors from Examples 121 to 130 and Comparative Examples 49 to 52 was measured in the same manner as in the above-described Examples and Comparative Examples. The results of the charge retention rate measurement are shown in Table 13.

TABLE 13

| specimen | retention rate % | Specimen | retention rate % |
|---|---|---|---|
| Example 121 | 95.3 | Comp. Example 49 | 87.2 |
| Example 122 | 94.9 | Comp. Example 50 | 87.5 |
| Example 123 | 94.9 | Comp. Example 51 | 87.4 |
| Example 124 | 95.2 | Comp. Example 52 | 87.3 |
| Example 125 | 94.8 | | |
| Example 126 | 95.2 | | |
| Example 127 | 94.8 | | |
| Example 128 | 95.1 | | |
| Example 129 | 95.0 | | |
| Example 130 | 94.8 | | |

It is apparent from Table 13 that the potential retention rates of all Examples are high and favorable, while the potential retention rates of all Comparative Examples are lower in comparison with those of Examples.

Example 131

A photoconductor was fabricated in the same manner as in Example 1 except that the titanyloxophthalocyanine was replaced by titanyl tetrachlorophthalocyanine synthesized according to a common method.

Example 132

A photoconductor was fabricated in the same manner as in Example 131 except that the quantity of the ligand-bonded metal phthalocyanine compound added to 1 mol of the titanyl tetrachlorophthalocyanine was changed to 10 μmol.

Example 133

A photoconductor was fabricated in the same manner as in Example 131 except that the quantity of the ligand-bonded metal phthalocyanine compound added to 1 mol of the titanyl tetrachlorophthalocyanine was changed to 1 mmol.

Example 134

A photoconductor was fabricated in the same manner as in Example 131 except that the quantity of the ligand-bonded metal phthalocyanine compound added to 1 mol of the titanyl tetrachlorophthalocyanine was changed to 100 mmol.

Example 135

A photoconductor was fabricated in the same manner as in Example 131 except that the quantity of the ligand-bonded metal phthalocyanine compound added to 1 mol of the titanyl tetrachlorophthalocyanine was changed to 200 mmol.

Example 136

A photoconductor was fabricated in the same manner as in Example 131 except that after adding 100 nmol of the ligand-bonded metal phthalocyanine compound to 1 mol of the titanyl tetrachlorophthalocyanine, the resulting mixture was subjected to an acid pasting treatment with 96% sulfuric acid, then washed with water and dried to obtain a titanyl tetrachlorophthalocyanine containing a ligand-bonded metal phthalocyanine compound.

Example 137

A photoconductor was fabricated in the same manner as in Example 136 except that the quantity of the ligand-bonded metal phthalocyanine compound added to 1 mol of the titanyl tetrachlorophthalocyanine was changed to 10 $\mu$mol.

Example 138

A photoconductor was fabricated in the same manner as in Example 136 except that the quantity of the ligand-bonded metal phthalocyanine compound added to 1 mol of the titanyl tetrachlorophthalocyanine was changed to 1 mmol.

Example 139

A photoconductor was fabricated in the same manner as in Example 136 except that the quantity of the ligand-bonded metal phthalocyanine compound added to 1 mol of the titanyl tetrachlorophthalocyanine was changed to 100 mmol.

Example 140

A photoconductor was fabricated in the same manner as in Example 136 except that the quantity of the ligand-bonded metal phthalocyanine compound added to 1 mol of the titanyl tetrachlorophthalocyanine was changed to 200 mmol.

Comparative Example 53

A photoconductor was fabricated in the same manner as in Example 131 except that the quantity of the ligand-bonded metal phthalocyanine compound added to 1 mol of the titanyl tetrachlorophthalocyanine was changed to 50 nmol.

Comparative Example 54

A photoconductor was fabricated in the same manner as in Example 131 except that the quantity of the ligand-bonded metal phthalocyanine compound added to 1 mol of the titanyl tetrachlorophthalocyanine was changed to 300 mmol.

Comparative Example 55

A photoconductor was fabricated in the same manner as in Example 136 except that the quantity of the ligand-bonded metal phthalocyanine compound added to 1 mol of the titanyl tetrachlorophthalocyanine was changed to 50 nmol.

Comparative Example 56

A photoconductor was fabricated in the same manner as in Example 136 except that the quantity of the ligand-bonded metal phthalocyanine compound added to 1 mol of the titanyl tetrachlorophthalocyanine was changed to 300 mmol.

An electric characteristic of each of the photoconductors from Examples 131 to 140 and Comparative Examples 45 to 56 was measured in the same manner as in the above-described Examples and Comparative Examples. The results of the charge retention rate measurement are shown in Table 14.

TABLE 14

| specimen | retention rate % | Specimen | retention rate % |
|---|---|---|---|
| Example 131 | 97.5 | Comp. Example 53 | 90.3 |
| Example 132 | 97.7 | Comp. Example 54 | 90.4 |
| Example 133 | 97.0 | Comp. Example 55 | 90.7 |
| Example 134 | 97.1 | Comp. Example 56 | 90.2 |
| Example 135 | 96.9 | | |
| Example 136 | 97.6 | | |
| Example 137 | 97.2 | | |
| Example 138 | 97.4 | | |
| Example 139 | 96.8 | | |
| Example 140 | 97.0 | | |

It is apparent from Table 14 that the potential retention rates of all Examples are high and favorable, while the potential retention rates of all Comparative Examples are lower in comparison with those of Examples.

Example 141

A photoconductor was fabricated in the same manner as in Example 1 except that the ligand-bonded metal phthalocyanine compound was replaced by (monochlorophthalocyano)chloroiridium(III)-phthalonitrile (hereinafter, simply referred to as "iridium pentamer") synthesized according to the reference: *J. Inorg. Nucl. Chem*, 1965, vol. 27, p. 1311–1319, herein incorporated by reference.

Example 142

A photoconductor was fabricated in the same manner as in Example 141 except that the quantity of the iridium pentamer added to 1 mol of the titanyloxophthalocyanine was changed to 10 $\mu$mol.

Example 143

A photoconductor was fabricated in the same manner as in Example 141 except that the quantity of the iridium pentamer added to 1 mol of the titanyloxophthalocyanine was changed to 1 mmol.

Example 144

A photoconductor was fabricated in the same manner as in Example 141 except that the quantity of the iridium pentamer added to 1 mol of the titanyloxophthalocyanine was changed to 100 mmol.

Example 145

A photoconductor was fabricated in the same manner as in Example 141 except that the quantity of the iridium pentamer added to 1 mol of the titanyloxophthalocyanine was changed to 200 mmol.

Example 146

A photoconductor was fabricated in the same manner as in Example 141 except that after adding 100 nmol of the iridium pentamer to 1 mol of the titanyloxophthalocyanine, the resulting mixture was subjected to an acid pasting treatment with 96% sulfuric acid, then washed with water and dried to obtain a titanyloxophthalocyanine containing an iridium pentamer.

Example 147

A photoconductor was fabricated in the same manner as in Example 146 except that the quantity of the iridium pentamer added to 1 mol of the titanyloxophthalocyanine was changed to 10 $\mu$mol.

Example 148

A photoconductor was fabricated in the same manner as in Example 146 except that the quantity of the iridium pentamer added to 1 mol of the titanyloxophthalocyanine was changed to 1 mmol.

Example 149

A photoconductor was fabricated in the same manner as in Example 146 except that the quantity of the iridium pentamer added to 1 mol of the titanyloxophthalocyanine was changed to 100 mmol.

Example 150

A photoconductor was fabricated in the same manner as in Example 146 except that the quantity of the iridium pentamer added to 1 mol of the titanyloxophthalocyanine was changed to 200 mmol.

Comparative Example 57

A photoconductor was fabricated in the same manner as in Example 141 except that the quantity of the iridium pentamer added to 1 mol of the titanyloxophthalocyanine was changed to 50 nmol.

Comparative Example 58

A photoconductor was fabricated in the same manner as in Example 141 except that the quantity of the iridium pentamer added to 1 mol of the titanyloxophthalocyanine was changed to 300 mmol.

Comparative Example 59

A photoconductor was fabricated in the same manner as in Example 146 except that the quantity of the iridium pentamer added to 1 mol of the titanyloxophthalocyanine was changed to 50 nmol.

Comparative Example 60

A photoconductor was fabricated in the same manner as in Example 146 except that the quantity of the iridium pentamer added to 1 mol of the titanyloxophthalocyanine was changed to 300 mmol.

An electric characteristic of each of the photoconductors from Examples 141 to 150 and Comparative Examples 57 to 60 was measured in the same manner as in the above-described Examples and Comparative Examples. The results of the charge retention rate measurement are shown in Table 15.

TABLE 15

| specimen | Retention rate % | Specimen | retention rate % |
|---|---|---|---|
| Example 141 | 97.5 | Comp. Example 57 | 90.1 |
| Example 142 | 97.7 | Comp. Example 58 | 89.4 |
| Example 143 | 97.6 | Comp. Example 59 | 90.7 |
| Example 144 | 97.4 | Comp. Example 60 | 89.8 |
| Example 145 | 97.3 | | |
| Example 146 | 97.9 | | |
| Example 147 | 97.4 | | |
| Example 148 | 97.5 | | |
| Example 149 | 97.6 | | |
| Example 150 | 97.4 | | |

It is apparent from Table 15 that the potential retention rates of all Examples are high and favorable, while the potential retention rates of all Comparative Examples are lower in comparison with those of Examples.

Effect of the Invention

A photoconductor of the present invention comprises a photosensitive layer containing at least a phthalocyanine compound as a photosensitive material, wherein the photosensitive layer contains a metal phthalocyanine compound having a molecular structure in which a structure equivalent to an o-phthalonitrile compound is bonded as a ligand. In the photoconductor of the invention, the ligand-bonded metal phthalocyanine is contained in the photosensitive layer in an amount from about 100 nmol to about 200 mmol with respect to 1 mol of the phthalocyanine compound, providing an electrophotographic photoconductor of an excellent potential retention rate.

The present invention further provides a method for manufacturing a photoconductor comprising a step for forming a photosensitive layer by coating a conductive substrate with a coating liquid including a charge generating substance, wherein the coating liquid further contains a metal phthalocyanine compound having a molecular structure in which a structure equivalent to an o-phthalonitrile compound is bonded as a ligand. In the method of the invention, the ligand-bonded metal phthalocyanine is contained in the coating liquid for the photosensitive layer in an amount from about 100 nmol to about 200 mmol with respect to 1 mol of the phthalocyanine compound, providing a method for manufacturing an electrophotographic photoconductor of an excellent potential retention rate.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic photoconductor, comprising:

a conductive substrate;

a photosensitive layer on said conductive substrate;

said photosensitive layer containing at least one phthalocyanine compound as a photosensitive material on said conductive substrate; and said photosensitive layer contains a metal phthalocyanine compound bonded by an o-phthalonitrile compound as a ligand, in an amount of from about 100 nmol to about 200 mmol with respect to 1 mol of said phthalocyanine compound.

2. The electrophotographic photoconductor according to claim 1, wherein said phthalocyanine compound is titanyloxophthalocyanine.

3. The electrophotographic photoconductor according to claim 2, wherein said photosensitive layer contains, as charge generation substances, titanyloxophthalocyanine having mass number 576 and a titanyloxophthalocyanine bonded by an o-phthalonitrile compound as a ligand of mass number 704, and a peak intensity of mass number 704 in a mass spectroscopy is in a range between $10^{-5}$% and 20% with respect to a peak intensity of mass number 576.

4. The electrophotographic photoconductor according to claim 1, wherein said phthalocyanine compound is metal-free phthalocyanine.

5. The electrophotographic photoconductor according to claim 1, wherein a core element of said phthalocyanine compound is a transition metal.

6. The electrophotographic photoconductor according to claim 5, wherein said transition metal is selected from the group consisting of titanium, vanadium, chromium, manganese, iron, cobalt, nickel, copper, zirconium and niobium.

7. The electrophotographic photoconductor according to claim 1, wherein a core element of said phthalocyanine compound is selected from a group consisting of indium, gallium, aluminum, germanium and tin.

8. The electrophotographic photoconductor according to claim 1, wherein said phthalocyanine compound is represented by formula (1)

(1)

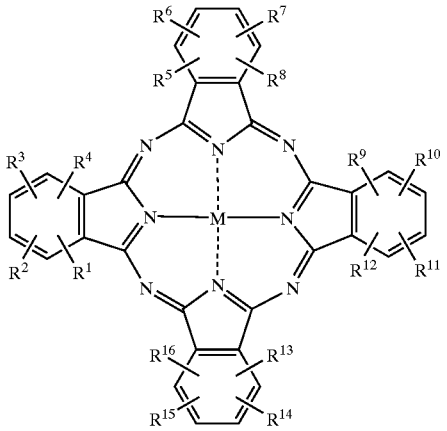

wherein M is selected from the group consisting of a metal element, a metal oxide, a metal halide, a metal hydroxide, a silicon compound and a phosphorus compound, and each of $R^1$ to $R^{16}$ is selected independently from the group consisting of a hydrogen atom, a halogen atom, a hydroxyl group, a nitro group, a cyano group, an ester group, an alkyl group, an allyl group, an alkoxyl group, an aryl group, and a phenoxyl group.

9. The electrophotographic photoconductor according to claim 1, wherein said metal phthalocyanine compound is a titanyloxophthalocyanine.

10. The electrophotographic photoconductor according to claim 1, wherein said o-phthalonitrile compound is represented by formula (2)

(2)

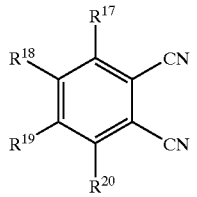

wherein each of $R^{17}$ to $R^{20}$ is selected independently from the group consisting of a hydrogen atom, a halogen atom, a hydroxyl group, a nitro group, a cyano group, an ester group, an alkyl group, an allyl group, an alkoxyl group, an aryl group, and a phenoxyl group.

11. A method for manufacturing an electrophotographic photoconductor, comprising:

providing a conductive substrate;

forming a photosensitive layer by coating said conductive substrate with a coating liquid containing at least one charge generating substance, wherein said coating liquid contains a phthalocyanine compound and a metal phthalocyanine compound bonded by an o-phthalonitrile compound as a ligand, and said metal phthalocyanine compound is contained in an amount from about 100 nmol to about 200 mmol with respect to 1 mol of said phthalocyanine compound.

* * * * *